US008388083B2

(12) United States Patent
Lane

(10) Patent No.: US 8,388,083 B2
(45) Date of Patent: Mar. 5, 2013

(54) SYSTEM AND METHOD FOR EFFICIENTLY BOOSTING DRIVE CAPABILITY FOR HIGH-VOLTAGE LINEAR POWER AMPLIFICATION

(75) Inventor: Richard I. Lane, Bend, OR (US)

(73) Assignee: Xerox Corporation, Norwalk, CT (US)

( * ) Notice: Subject to any disclaimer, the term of this patent is extended or adjusted under 35 U.S.C. 154(b) by 440 days.

(21) Appl. No.: 12/411,993

(22) Filed: Mar. 26, 2009

(65) Prior Publication Data

US 2010/0244932 A1 Sep. 30, 2010

(51) Int. Cl.
*B41J 29/38* (2006.01)

(52) U.S. Cl. ..... 347/9; 5/12

(58) Field of Classification Search ..... 347/5, 9, 347/10, 12, 11; 363/60; 361/225
See application file for complete search history.

(56) References Cited

U.S. PATENT DOCUMENTS

| | | | | |
|---|---|---|---|---|
| 4,656,574 | A * | 4/1987 | Salchli | 363/60 |
| 5,677,647 | A | 10/1997 | Knierim | |
| 6,338,537 | B1 * | 1/2002 | Nou | 347/9 |
| 6,504,701 | B1 * | 1/2003 | Takamura et al. | 361/225 |
| 6,582,043 | B2 * | 6/2003 | Ishizaki | 347/12 |

* cited by examiner

*Primary Examiner* — Lam S Nguyen
(74) *Attorney, Agent, or Firm* — Marger Johnson & McCollom PC

(57) ABSTRACT

A system for efficiently boosting drive capability for high-voltage linear power amplification to supply transducers in a print head is provided. A linear power amplifier to drive the transducers in the print head includes a charge pump capacitor to boost the output voltage of the amplifier above the supply rail voltage. The amplifier can provide both positive and negative output pulses to drive the transducers. A distribution switch is used to distribute the output pulses among multiple transducers and a biasing circuit provides proper sequencing and timing signals to generate smooth output pulses. A method for driving a plurality of transducers in a print head using a charge pump capacitor is also provided.

15 Claims, 12 Drawing Sheets

SYSTEM AND METHOD FOR EFFICIENTLY BOOSTING DRIVE CAPABILITY FOR HIGH-VOLTAGE LINEAR POWER AMPLIFICATION

BACKGROUND

Many types of modern electronic devices, for example, inkjet printers, include some form of fluid dispensing system. Fluid dispensing assemblies generally include structures to take the fluid into the assembly or store it locally and route it to the appropriate output port, an actuator to selectively cause the fluid to exit the output port, and control circuitry to control the selection and activation of the actuator. In some instances, the structures to route the ink to the output port and structures upon which the actuators operate may be contained in a fluid dispensing subassembly.

One exemplary fluid dispensing assembly consists of a print head, either for liquid ink or solid inks that are melted. The print head can include transducers to control dispensation of the ink. These transducers may be electromechanical, microelectromechanical systems (MEMS), acoustic, piezoelectric, etc. The transducer, when activated by an electrical signal, can cause ink to exit the print head through a jet or nozzle. In some examples, when a system activates the transducer with an electrical signal, the transducer actuates and displaces a diaphragm or other structure that in turn causes the ink to pass through the jet onto a printing substrate.

High-voltage linear power amplification is typically used to create the drive waveforms for piezo-electric transducers (PZT) used in some solid ink print heads, as an example of an actuator. These amplifiers (also referred to as waveamps) are optimized for simplicity and low cost to minimize the overall cost of the printer. Often one amplifier drives an entire print head, which may have around a thousand actuator elements. As the technology of printers, print heads, and ink have advanced, the power demands of the actuator waveamps have also increased. These increased power demands have driven research into alternative amplifier architectures with higher efficiency and/or reduced power consumption.

Various alternative techniques have been proposed to improve the efficiency of high-voltage power amplifiers, particularly with respect to audio amplifier applications. Some techniques utilize transistor matching techniques to parallel devices. Other techniques deal with dynamically driven or adaptive power supply rails or driving output devices to one or more intermediate power supply rails to help reduce the power dissipation in the amplifiers. However, these approaches are less desirable for low-cost actuator driver applications, such as those used in printer heads.

DETAILED DESCRIPTION OF THE EMBODIMENTS

For ease of understanding of the embodiments described herein, the discussion will focus on a print head as an example of an electronic device using a high-power linear amplifier for transducers. The discussion may focus on PZT transducers/actuators, but the application of the embodiments may extend far beyond. This description is merely an example and is not intended to, nor should it be interpreted as, any limitation on the scope of the claims. The embodiments described herein may apply to any fluid dispenser or any other type of electronic device that uses high-power linear amplification. Similarly, the term 'printer' does not limit itself to devices that just dispense ink, solid ink or otherwise. Other materials may be dispensed by devices that have many similarities to ink printers, but may actually dispense other materials, such as biological fluids, pharmaceuticals, etc.

Figure 1:
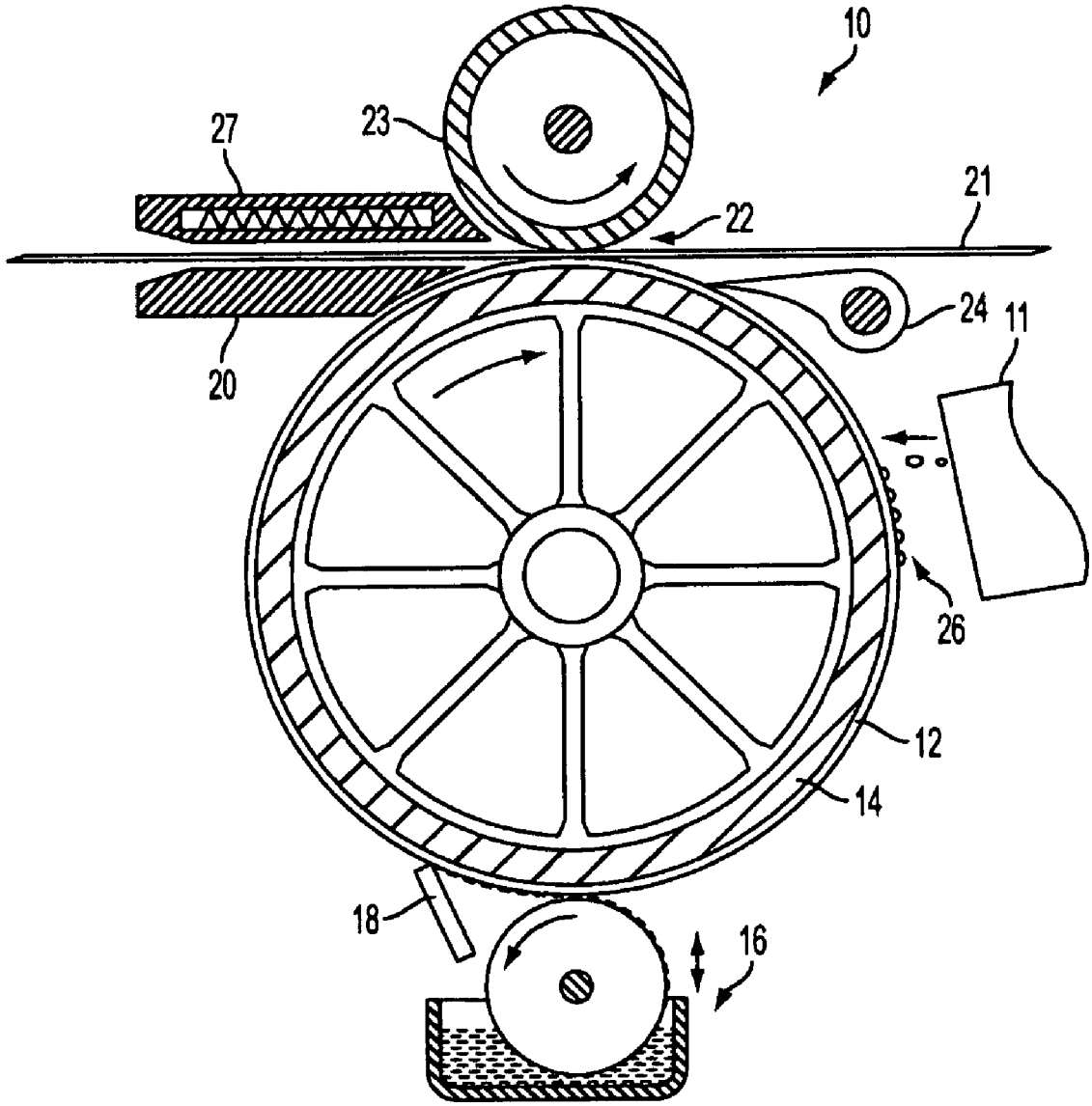
FIG. 1 shows an example of a printer.

FIG. 1 shows an example of a printer 10. The term printer as used here applies to any print engine, whether it is part of a printer, copier, fax machine, scanner or a multi-function device that has the capability of performing more than one of these functions. Further, the term printer can include any type of fluid dispensing assembly that dispenses fluids regardless of their source or nature. The printer has a print head 11 that deposits ink dots 26 on an intermediate transfer surface 12 to form an image. As further described below, the print head 11 can include an amplifier to facilitate dispensation of the ink to form ink dots 26. The support structure 14 supports the intermediate transfer surface 12. For ease of discussion, the support structure will be referred to here as a drum, but may be a drum, a belt, etc. The intermediate transfer surface 12 may be a liquid applied to the support structure 14 by an applicator, web, wicking apparatus, or metering blade assembly 18 from a reservoir 16.

The ink dots 26 form an image that is transferred to a piece of media 21 that is guided past the intermediate transfer surface by a substrate guide 20, and a media pre-heater 27. In solid ink jet systems, the system pre-heats the ink and the media prior to transferring the image to the media in the form of the ink dots. A pressure roller 23 transfers and fixes (transfixes) the ink dots onto the media at the nip 22. The nip is defined as the contact region between the media and the intermediate transfer surface. It is the region in which the pressure roller compresses the media against the intermediate transfer surface. This pressure, combined with elevated temperatures, achieves the transfer of the image. One or more stripper fingers, such as 24, may assist in lifting the media away from the intermediate transfer surface.

Figure 2:
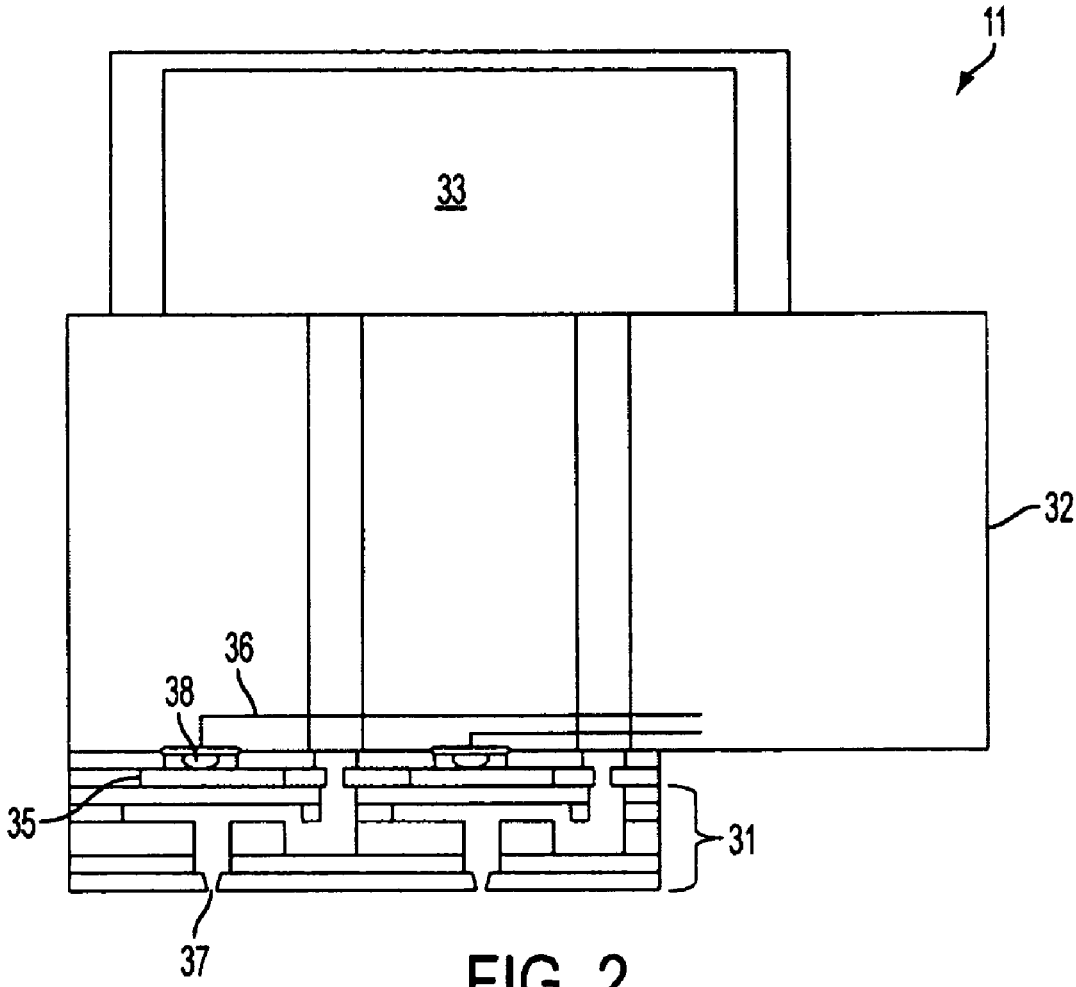
FIG. 2 shows an example of a print head of the printer of FIG. 1.

FIG. 2 shows one example of the print head 11 of FIG. 1. The print head 11 has a circuit board 32, through which the ink from the manifold 33 travels to reach a fluid dispensing subassembly 31. The fluid dispensing subassembly 31 may include a transducer, such as a piezoelectric transducer 35, that causes the fluid to exit the subassembly, a diaphragm 38 upon which the transducer operates, and an aperture or nozzle 37 through which the fluid leaves the print head 11.

In operation, a signal to dispense fluid from a particular nozzle is received, such as through circuit trace 36. This signal is then transmitted to the transducer 35. When the transducer operates, it presses against the diaphragm 38, which then causes the fluid to be ejected through the nozzle 37 onto a print substrate or surface. The signal supplied on circuit trace 36 to operate the transducer 35 can originate from circuitry including an amplifier according to the embodiments described below.

Figure 3A:
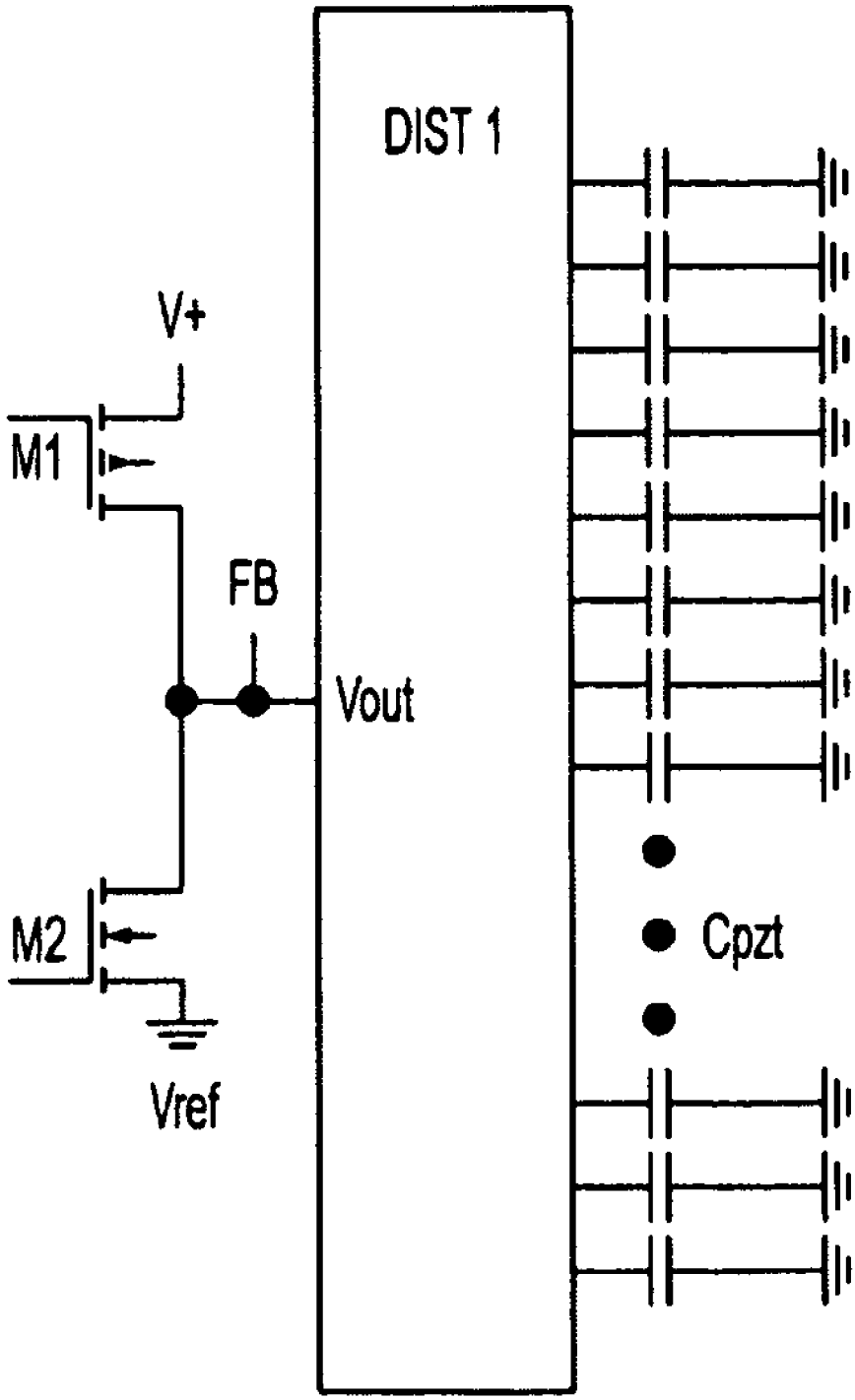
FIGS. 3A and 3B illustrate an embodiment of a linear power amplifier output driver stage and the corresponding output waveform, respectively.
Figure 3B:
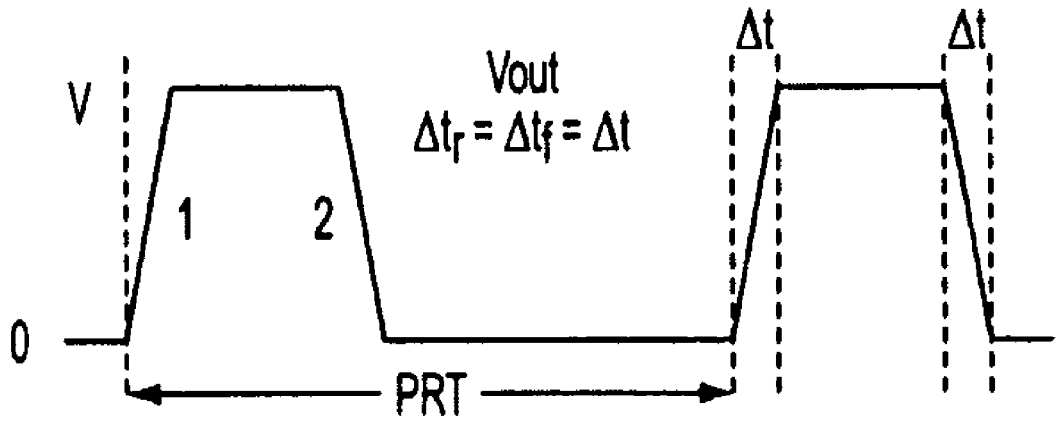

FIGS. 3A and 3B illustrate an embodiment of a linear power amplifier output driver stage and the corresponding output waveform, respectively. Referring to FIGS. 3A and 3B a linear power amplifier includes two Metal-Oxide-Semiconductor Field Effect Transistors (MOSFETs) M1 and M2 that produce an output voltage $V_{out}$ at an output node. The output voltage $V_{out}$ is supplied to the PZT transducers through a distribution switch DIST1. The distribution switch DIST1 can select one or more of the PZT transducers to connect to the output voltage $V_{out}$ on the output node at a given time. In this way, the distribution switch DIST1 can determine the arrangement of ink dots 26 deposited on the media 21. The multiple PZT transducers are represented as parallel capacitors owing to their capacitive characteristics. A person of ordinary skill in the art will recognize that the amount of capacitive load presented to the linear power amplifier will depend on the number of transducers that are activated at any given time (or for any given pulse cycle).

As shown in FIG. 3B, during the first part of a pulse cycle (portion 1 of the pulse cycle), M1 is driving the output node toward the positive rail voltage $V_+$. During the second part of the cycle (portion 2 of the pulse cycle), M2 is driving the output node toward $V_{ref}$. This example illustrates the output node minimum voltage being driven to the $V_{ref}$ rail. In FIG. 3A, $V_{ref}$ is shown as ground but it may be any voltage less than $V_+$, for example, a negative voltage.

A person of ordinary skill in the art will recognize that M1 and M2 do not turn on and off instantaneously, and thus there is a rise time $\Delta t_r$ and fall time $\Delta t_f$ associated with the output voltage $V_{out}$. For the sake of illustration, the rise time $\Delta t_r$ and fall time $\Delta t_f$ are illustrated as being equal ($\Delta t$), but this does not have to be the case. A person of ordinary skill in the art will appreciate that current flows only when the PZT elements are charged or discharged. Thus, the drive current magnitude and duration are determined by the rise and fall times, $\Delta t_r$ and $\Delta t_f$. Further, the current during the transitions will be constant for a constant slew rate. Significant amounts of power are undesirably dissipated during these rise and fall times as the pulses in the output waveform transition to and from the high voltage state, as further shown below in equations 1-5.

In the amplifier of FIG. 3A, the voltage supplied to the PZT transducers can be increased by increasing $V_+$. However, increasing $V_+$ leads to increased cost both in the circuitry to generate $V_+$ and the construction of MOSFETs M1 and M2. Further, increasing $V_+$ leads to increased power dissipation in the amplifier, as shown by Equations 1-5.

In equations 1-5, P refers to power, V refers to voltage (for instance, $V_+$), $\Delta t$ refers to the rise and fall times of the output waveform, and PRT refers to the period of the output waveform. It should be noted that the output waveform may contain multiple pulses of varying amplitudes that are provided in a repeating fashion, in which case PRT can be referred to as the pulse repetition period. As shown in Equations 1-5, as $V_+$ increases, the power dissipated also increases.

$$P_{total_dissipated} = V \cdot I \cdot \frac{\Delta t}{PRT} \quad \text{Equation 1}$$

$$P_{charging_PZT} = \frac{V \cdot I}{2} \cdot \frac{\Delta t}{PRT} \quad \text{Equation 2}$$

$$P_{discharging_PZT} = \frac{V \cdot I}{2} \cdot \frac{\Delta t}{PRT} \quad \text{Equation 3}$$

$$P_{dissipated_MOSFET1} = \left(V - \frac{V}{2}\right) \cdot I \cdot \frac{\Delta t}{PRT} \quad \text{Equation 4}$$

$$P_{dissipated_MOSFET2} = \frac{V}{2} \cdot I \cdot \frac{\Delta t}{PRT} \quad \text{Equation 5}$$

In the linear power amplifier configuration of FIG. 3A, two power MOSFETs are used to provide the output waveform; one to drive the output voltage high and the other to drive the output voltage back low. As the power dissipation is increased, the two power MOSFETs can be over-stressed and fail. Consequently, there is a limit on the amount that $V_+$ can be increased to meet demand for higher output voltages for the PZT transducers and an increased number of PZT transducers driven.

Figure 4A:
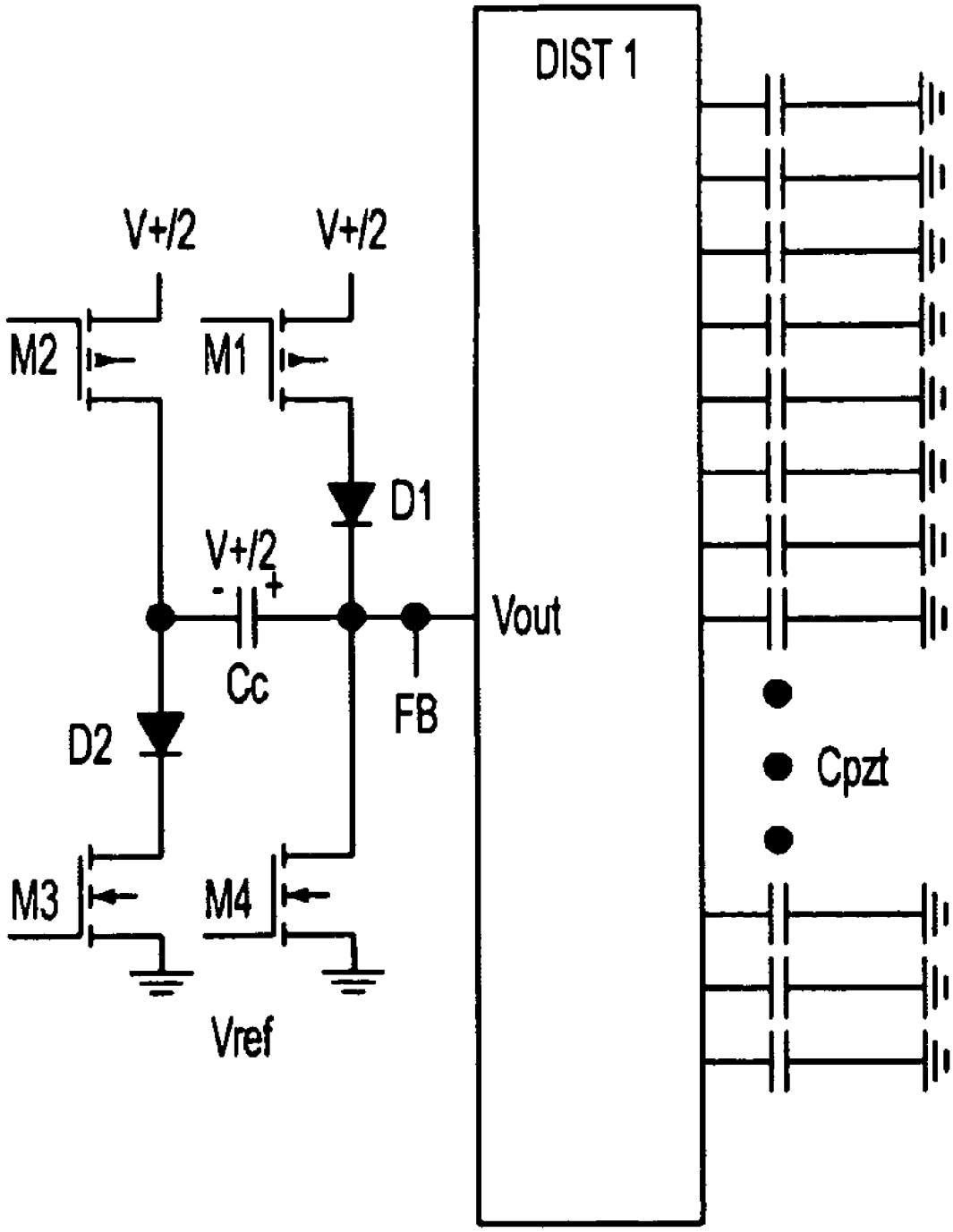
FIGS. 4A and 4B illustrate another embodiment of an AC or pulsed linear power amplifier output driver stage and the corresponding output waveform, respectively.
Figure 4B:
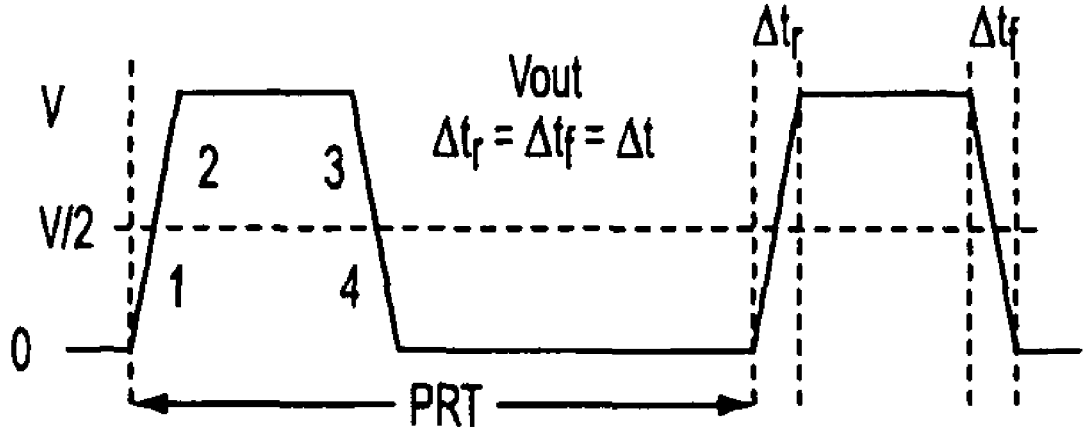

FIGS. 4A and 4B illustrate another embodiment of an AC or pulsed linear power amplifier output driver stage and the corresponding output waveform, respectively. Referring to FIGS. 4A and 4B, a linear power amplifier according to this embodiment includes four MOSFETs M1, M2, M3 and M4, a capacitor $C_c$, and two diodes D1 and D2 that work together to produce an output voltage $V_{out}$ at an output node. The output voltage $V_{out}$ can be supplied to the PZT transducers through a distribution switch DIST1, which can be used to select a subset of the transducers to receive the output signal at a given time (or for a given pulse cycle).

As shown in FIG. 4A, the linear power amplifier according to this embodiment includes two transistors, M1 and M2, connected to a reduced positive rail voltage, in this case $V_+/2$. The capacitor $C_c$ is included such that the transistors M1 and M2 connect to opposite terminals of the capacitor $C_c$, respectively. The linear power amplifier also includes two transistors, M3 and M4, connected to a reference voltage $V_{ref}$, which may be ground. The transistors M3 and M4 are also connected to opposite terminals of the capacitor $C_c$, respectively. The linear power amplifier may also include a first diode D1 connected between the capacitor $C_c$ and the transistor M1 and a second diode D2 connected between the capacitor $C_c$ and the transistor M3. The diodes D1 and D2 ensure the proper voltages are maintained on the capacitor $C_c$ to allow the charge-pump action described below.

As shown in FIG. 4B, during the first part of a pulse cycle (portion 1 of the pulse cycle), M1 drives the output node toward the positive rail voltage $V_+/2$. During this portion of the pulse cycle, M3 can be turned on to simplify the gate drive as it is disconnected from the output node by D2. The capacitor $C_c$ is initially charged such that the voltage $V_c$ across the capacitor becomes $V_+/2$. Next (portion 2 of the pulse cycle), M2 drives the output node through $C_c$, which pumps the output voltage $V_{out}$ up to $V_c+V_+/2=V_+$. Thus, at the end of the second part of the cycle, $V_{out}=V_+$ even though the positive rail voltage is only $V_+/2$. During the third part of the cycle (portion 3 of the pulse cycle), M3 drives the output node toward $V_{ref}$ through $C_c$ (restoring charge on $C_c$) causing $V_{out}$ to decrease to $V_+/2$. Finally (portion 4 of the pulse cycle), M4 drives the output node toward $V_{ref}$, completing the cycle.

Thus, at the end of the fourth part of the wave cycle, $V_{out}=V_{ref}$. In FIG. 4A, $V_{ref}$ is again shown as ground, but it may be any voltage less than $V_+/2$ sufficient to properly bias the MOSFETs M1-M4, for example, a negative voltage.

The linear power amplifier configuration shown in FIG. 4A takes advantage of the capacitive load nature of the PZT elements in solid ink print heads and their pulsed drive characteristics. Specifically, because the PZT transducers are a capacitive load, they form a capacitive divider with the charge capacitor $C_c$. Consequently, there is little or no DC load for the amplifier to drive. Thus, the linear power amplifier for PZT transducers can efficiently utilize charge-pump operation, as described above.

In the amplifier of FIG. 4A, the voltage supplied to the PZT transducers can be increased to approximately double the positive rail voltage without increasing the rail voltage itself. Therefore, less expensive circuitry can be used to generate $V_+/2$ and MOSFETs M1, M2, M3, and M4 do not have to be modified to handle increased power or voltages. Further, the power dissipation of the amplifier can be reduced, as shown below by Equations 6-12.

In equations 6-12, P refers to power, V refers to voltage (for instance, $V_+$), Δt refers to the rise and fall times of the output waveform, and PRT refers to the period of the output waveform. As shown in Equations 6-12, the ideal power dissipated in the amplifier is reduced by a factor of 2 and the individual MOSFET power dissipations are reduced by a factor of 4, as compared to the amplifier configuration of FIG. 3A.

$$P_{total_dissipated} = \frac{V \cdot I}{2} \cdot \frac{\Delta t}{PRT} \quad \text{Equation 6}$$

$$P_{charging_PZT} = \frac{\left(\frac{V}{2}\right) \cdot I}{2} \cdot \frac{\Delta t}{PRT} = \frac{V \cdot I}{4} \cdot \frac{\Delta t}{PRT} \quad \text{Equation 7}$$

$$P_{discharging_PZT} = \frac{\left(\frac{V}{2}\right) \cdot I}{2} \cdot \frac{\Delta t}{PRT} = \frac{V \cdot I}{4} \cdot \frac{\Delta t}{PRT} \quad \text{Equation 8}$$

$$P_{dissipated_MOSFET1} = \left[\left(\frac{V}{2}\right) - \frac{\left(\frac{V}{2}\right)}{2}\right] \cdot I \cdot \frac{\left(\frac{\Delta t}{2}\right)}{PRT} = \frac{V \cdot I}{8} \cdot \frac{\Delta t}{PRT} \quad \text{Equation 9}$$

$$P_{dissipated_MOSFET2} = \left[\left(\frac{V}{2}\right) - \left[\frac{V + \left(\frac{V}{2}\right)}{2} - \left(\frac{V}{2}\right)\right]\right] \cdot I \cdot \frac{\left(\frac{\Delta t}{2}\right)}{PRT} = \frac{V \cdot I}{8} \cdot \frac{\Delta t}{PRT} \quad \text{Equation 10}$$

$$P_{dissipated_MOSFET3} = \left[\frac{V + \left(\frac{V}{2}\right)}{2} - \left(\frac{V}{2}\right)\right] \cdot I \cdot \frac{\left(\frac{\Delta t}{2}\right)}{PRT} = \frac{V \cdot I}{8} \cdot \frac{\Delta t}{PRT} \quad \text{Equation 11}$$

$$P_{dissipated_MOSFET4} = \frac{\frac{V}{2} \cdot I}{2} \cdot \frac{\frac{\Delta t}{2}}{PRT} = \frac{V \cdot I}{8} \cdot \frac{\Delta t}{PRT} \quad \text{Equation 12}$$

The charge pump architecture described above with respect to FIGS. 4A and 4B uses a capacitor as an energy storage element to create an output pulse higher than the rail voltage. In this approach, additional transistors are used to drive various portions of the pulse signal generation, as shown in FIG. 4B. Therefore, a bias circuit (or individual bias circuits for each transistor) can be used to control the transistors for smooth pulse generation. The transistors can be biased on at low current levels to aid in smooth pulse generation. This bias condition also helps minimize the pulse start timing and timing consistency. Additionally, the bias circuit can be configured to minimize and eliminate undesired current shoot-through conditions between transistor pairs as drive conditions are switched. DC bias amplifier feedback can be also used to balance the amplifier currents and minimize any impact on individual transistor bias circuits.

Proper sequencing and timing of transistor bias signals can be accomplished by triggering on the 0V crossing of the amplifier side of the coupling capacitor $C_c$. This corresponds to approximately the midpoint of the output voltage range. The initial charge on the coupling capacitor $C_c$ can be varied with the pulse amplitude to center the pulse edge transitions. Further, the initial charge on the coupling capacitor $C_c$ can be determined from the pulse output waveform dynamically. One approach for providing proper sequencing and timing is to use a control device, such as an FPGA or custom ASIC, with individual device controls connected to transistor gate drivers. However, these approaches might lead to unwanted calibration processes. Alternatively, discrete analog circuitry can adequately address the sequencing for this complexity of implementation at a reasonable cost.

The linear power amplifier configuration of FIG. 4A uses a single power supply or rail voltage. Thus, only half the charging/discharging currents flow through the capacitor $C_c$, which reduces the capacitor losses. However, all of the charging current comes from the single power supply, which can cause increased supply voltage sag and/or decoupling requirements. In addition, DC feedback can be maintained for the output in this configuration. However, this configuration may produce additional complications with respect to charge restoration for the capacitor $C_c$.

Figure 5:
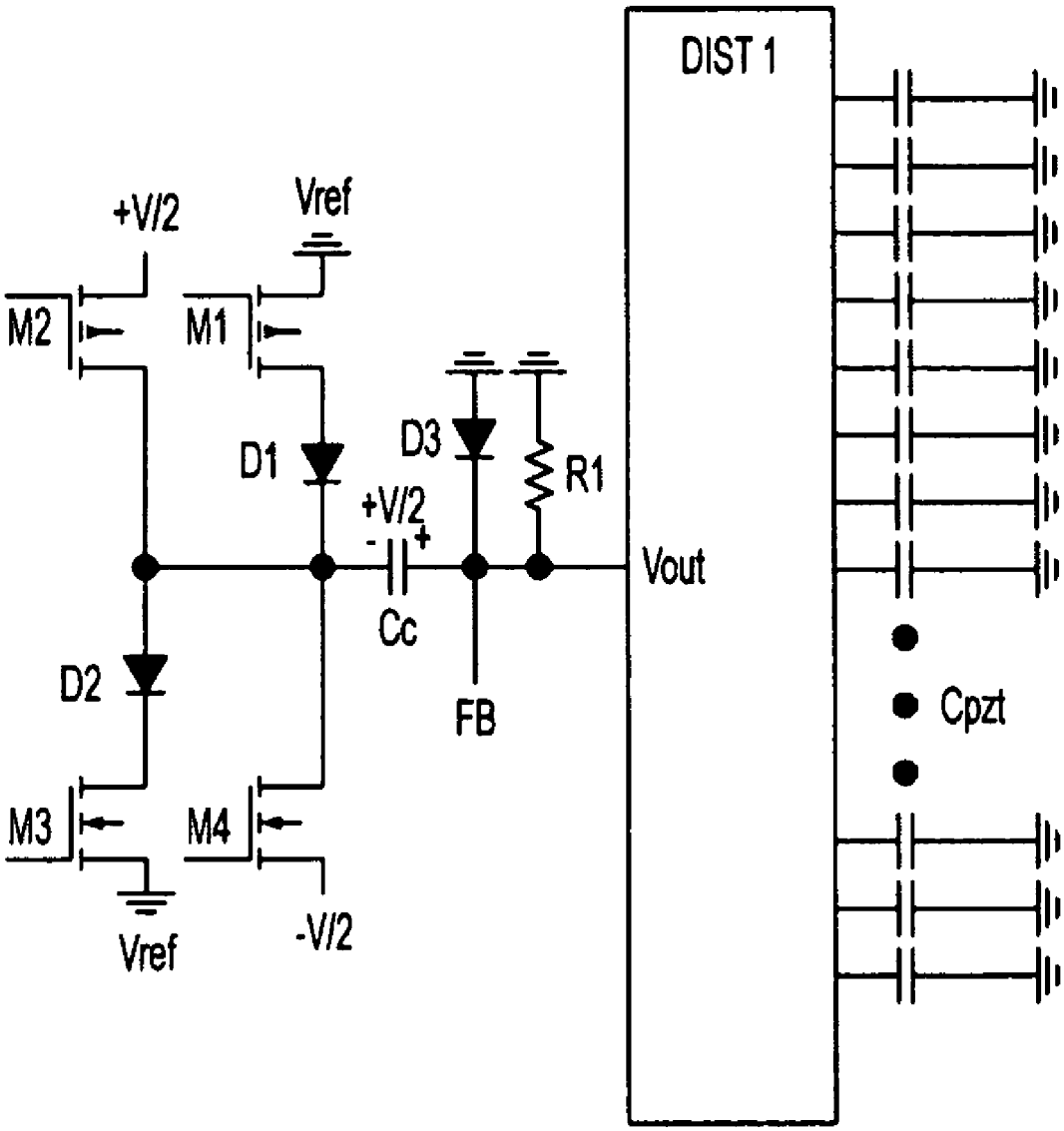
FIG. 5 illustrates a modified example of the linear power amplifier of FIG. 4.

FIG. 5 illustrates a modified example of the linear power amplifier of FIG. 4. Referring to FIG. 5, a linear power amplifier according to this modified embodiment includes four MOSFETs M1, M2, M3 and M4, a capacitor $C_c$, and two diodes D1 and D2 that work together to produce an output voltage $V_{out}$ at an output node. The output voltage $V_{out}$ can be supplied to the PZT transducers through a distribution switch DIST1, similar to previous embodiments. In this modified embodiment, all of the transistors are connected to the low voltage terminal of the charging capacitor $C_c$. Further, MOSFET M1 is connected to the reference voltage $V_{ref}$ rather than to the positive rail voltage $V_+/2$ and MOSFET M4 is connected to a negative rail voltage $-V/2$ rather than to the reference voltage $V_{ref}$. A resistor R1 and a diode D3 are connected between the output node and $V_{ref}$ to help bias the capacitor $C_c$ to provide the charge pump action.

In operation, MOSFET M1 starts the drive pulse and charges the low voltage terminal of the capacitor $C_c$ up to $V_{ref}$. MOSFET M2 then turns on and provides $V_+/2$ to the low voltage terminal of the capacitor $C_c$, which pumps up the output voltage $V_{out}$. MOSFET M2 starts driving when the voltage on the low voltage terminal of the capacitor $C_c$ crosses a threshold (for example, 0V). Therefore, the transition point is defined by the initial charge on the coupling capacitor, which could be dynamically controlled, and the final pulse amplitude is determined by the input drive under feedback control. The operation is similar for the pulse termination, first through MOSFET M3 and then through MOSFET M4. Thus, the output pulse will have a similar shape to that shown in FIG. 4B.

The modified configuration of FIG. 5 uses symmetrical power supplies for the transistors M1-M4 and automatically charges/recharges the capacitor $C_c$. Both the charging and discharging currents flow through the capacitor $C_c$ yielding substantially no net charge loss. During half of the charging time, current sources from the positive supply. During half of the discharging time, current sinks to the negative supply. This approach helps distribute the average current load for the power supply and reduces supply voltage sags and/or decoupling requirements, with respect to the configuration of FIG. 4A. However, DC feedback can be more complicated and the DC offset at the output node can be a function of the distribution switch input DC currents. According to some embodiments, compensating current can be supplied to the output node to null any initial DC offset.

In some applications, there are restrictions on the maximum voltage that can be input to the distribution switch. As an example, the distribution switch may have a maximum input voltage restriction of approximately 60V. However, a voltage of around 100V may be desirable to operate the PZT transducers. In order to address this issue, a linear pulse amplifier can have a positive and a negative output to the distribution switch such that the range between the positive and negative voltages exceeds the distribution switch's input voltage restriction without the individual inputs exceeding such restriction.

Figure 6A:
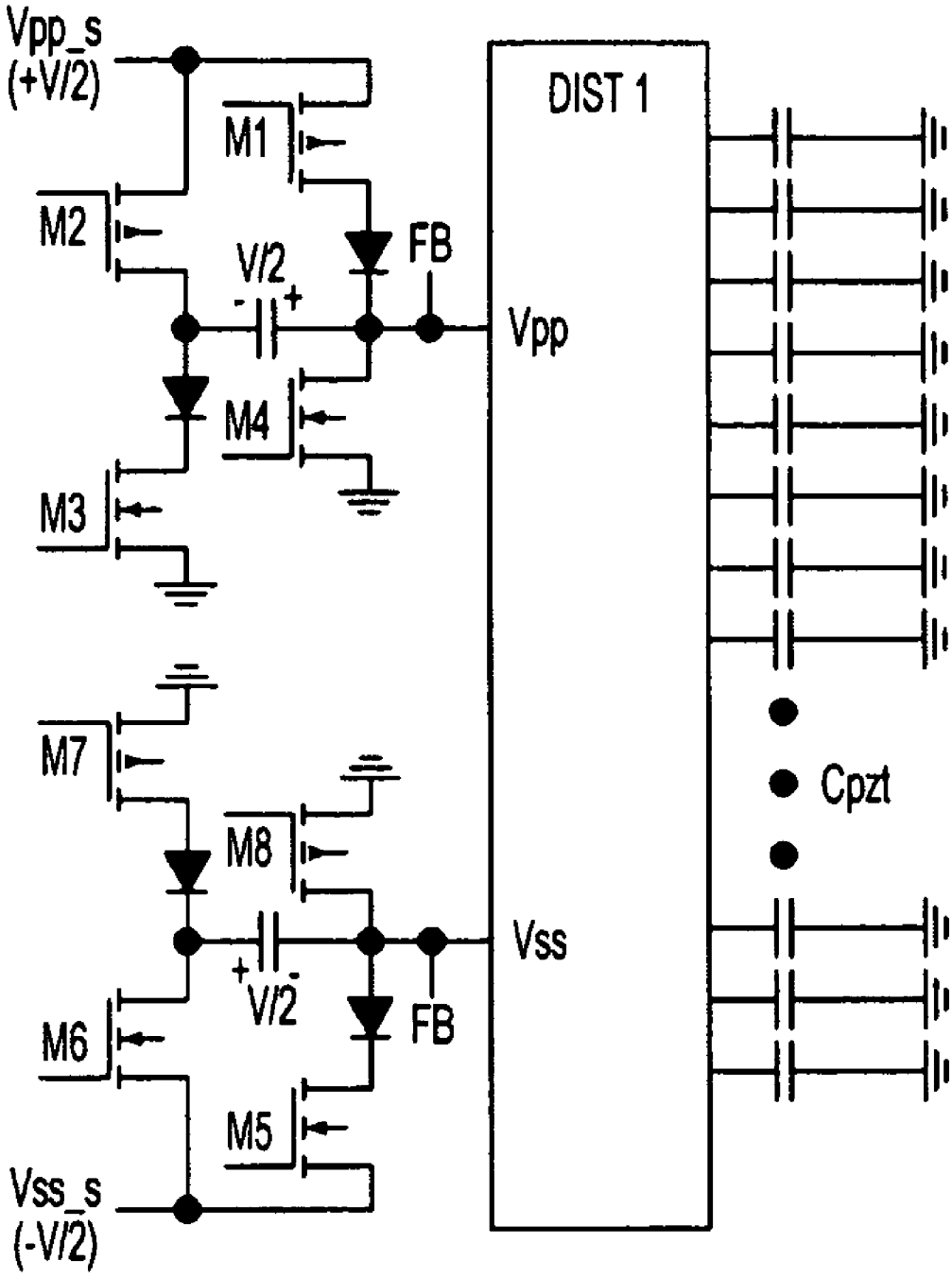
FIG. 6A illustrates an embodiment of a positive and negative polarity amplifier output driver stage.
Figure 6B:
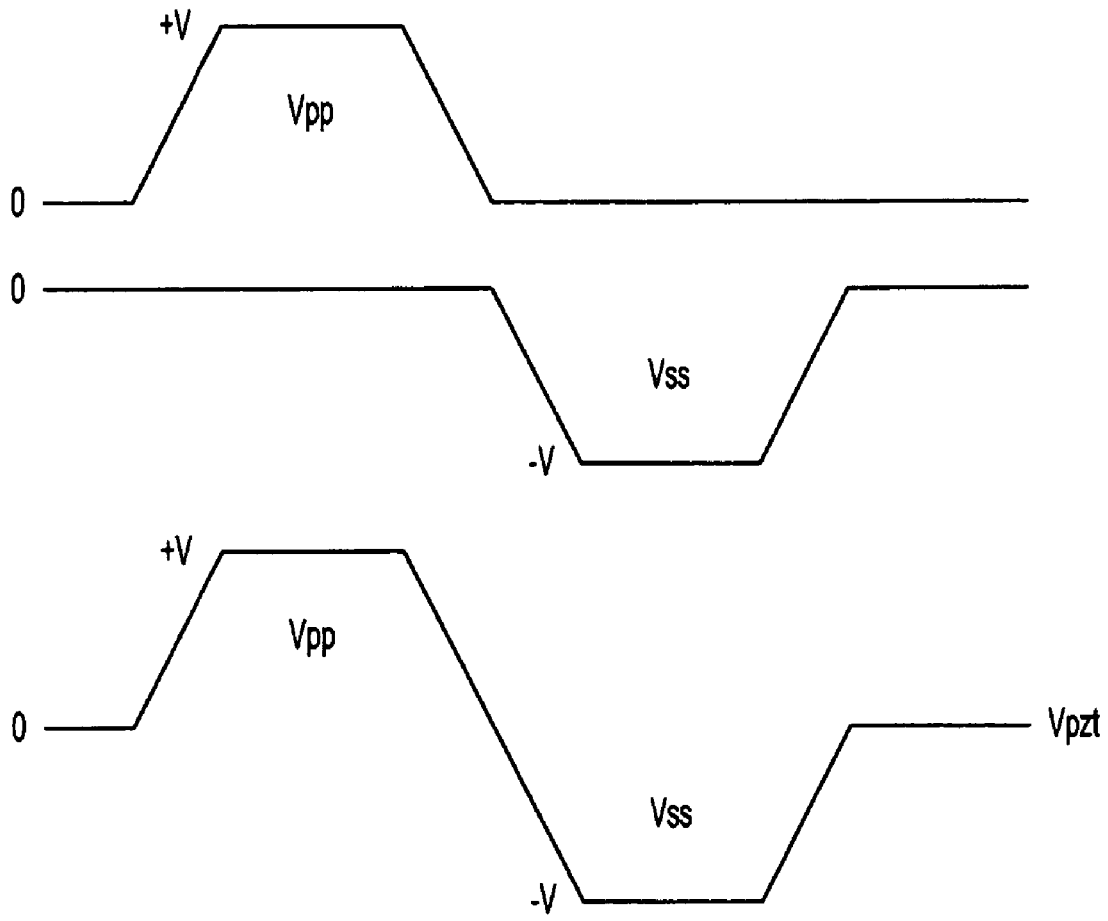
FIG. 6B shows the distribution switch input waveforms and output waveform to the transducers.

FIG. 6A illustrates an embodiment of a positive and negative polarity amplifier output driver stage. FIG. 6B shows the distribution switch DIST1 input waveforms and output waveform to the transducers. Referring to FIGS. 6A and 6B, a positive and negative pulse amplifier provides both a positive output $V_{pp}$ and a negative output $V_{ss}$ to the distribution switch DIST1. MOSFETs M1-M4 and their associated capacitor provide the positive output voltage $V_{pp}$ using a positive rail voltage of only $V_{pp}/2$, similar to the amplifier of FIG. 4A. MOSFETs M5-M8 and their associated capacitor provide the negative output voltage $V_{ss}$ using a negative rail voltage of only $V_{ss}/2$, also similar to the amplifier of FIG. 4A. Using this configuration both positive and negative pulse signals can be provided to the PZT transducers using reduced positive and negative rail voltages. Therefore, this configuration benefits from the same advantages described above with respect to the amplifier of FIG. 4A. Although the embodiment shown in FIG. 6A uses similar amplifiers to those shown in FIG. 4A, a person of ordinary skill in the art will appreciate that this embodiment could also use amplifiers similar to those shown in FIG. 5.

Figure 7A:
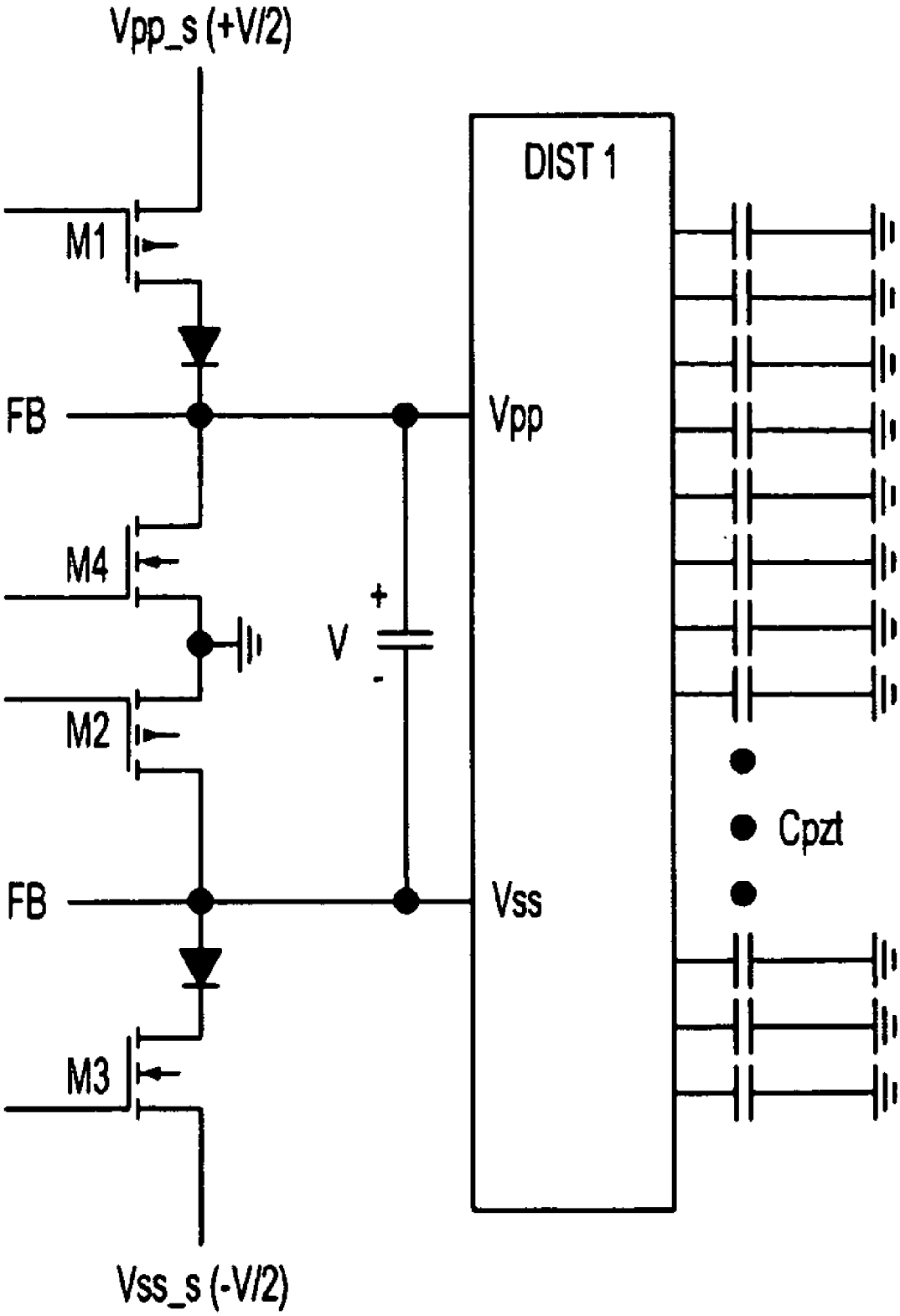
FIG. 7A illustrates an embodiment of a common drive dual polarity AC or pulsed linear power amplifier output driver stage.
Figure 7B:
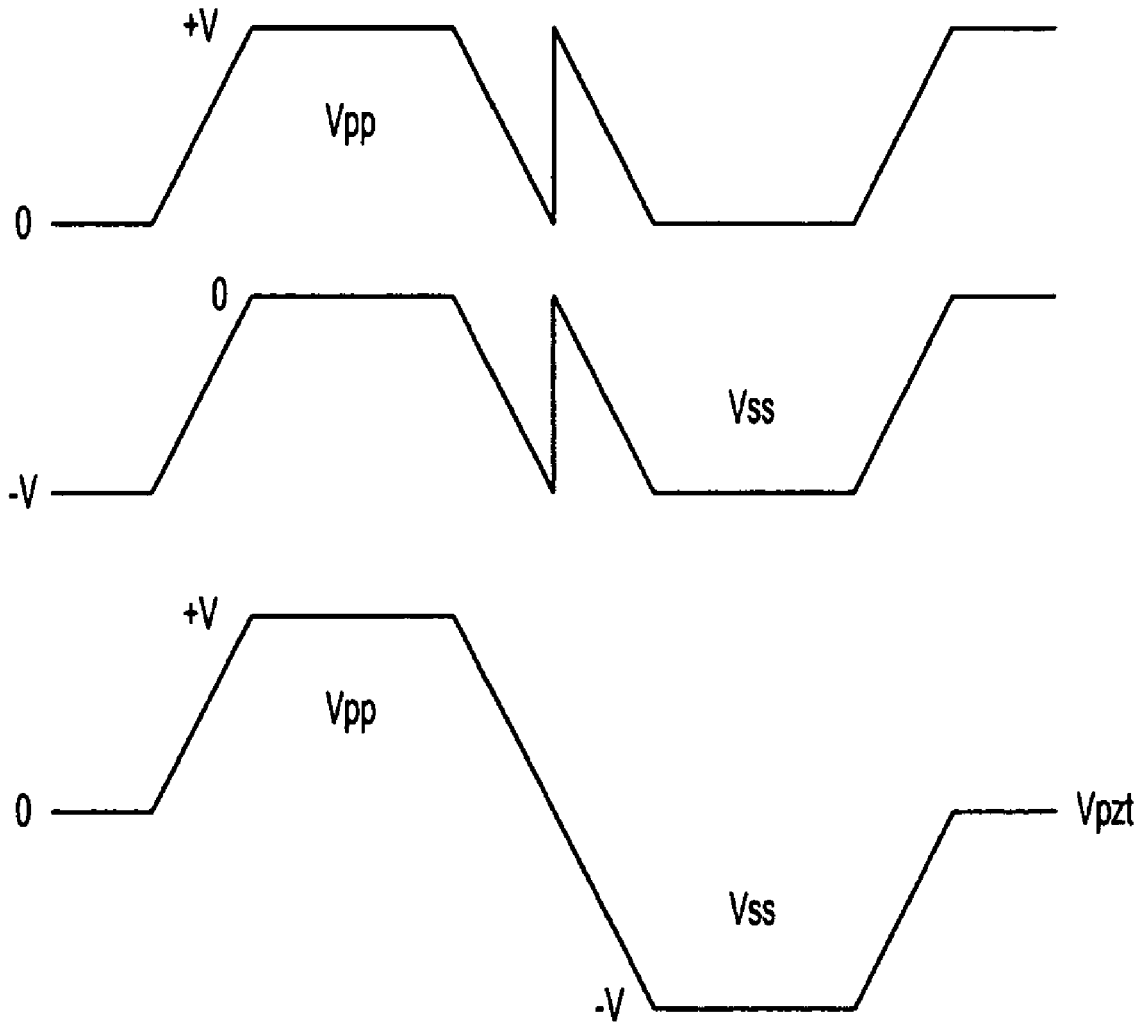
FIG. 7B shows the distribution switch input waveforms and output waveform to the transducers.

FIG. 7A illustrates an embodiment of a common drive dual polarity AC or pulsed linear power amplifier output driver stage. FIG. 7B shows the distribution switch DIST1 input waveforms and output waveform to the transducers. Referring to FIGS. 7A and 7B, the common drive pulse amplifier provides both a positive pulse output $V_{pp}$ and a negative pulse output $V_{ss}$, but only uses four MOSFETs M1-M4. The common drive pulse amplifier can reduce the power dissipated by a factor of 2 and the individual MOSFET power dissipated by a factor of 4, as compared to the amplifier configuration of FIG. 3A. Common drive may provide an opportunity for simpler, lower-cost gate driver circuitry. Common drive may also eliminate the potential for input differential over-voltage conditions to the distribution switch compared to independent dual polarity gate drivers. However, the inactive distribution switch input may have to handle the level-shifted common mode drive with the active input and thus it may use an un-loaded level shift transition to generate the opposite polarity pulse.

The common drive pulse amplifier according to this embodiment includes a first transistor M1 connected between the positive rail voltage $V_{pp_s}$ and the high-voltage terminal of a capacitor $C_c$. A second transistor M2 is connected between the low voltage terminal of the capacitor $C_c$ and the reference voltage $V_{ref}$. A third transistor M3 is connected between the low voltage terminal of the capacitor $C_c$ and a negative rail voltage $V_{ss_S}$ and a fourth transistor M4 is connected between the high voltage terminal of the capacitor $C_c$ and the reference voltage $V_{ref}$. In this configuration, the capacitor $C_c$ is configured to provide a positive output voltage to the distribution switch that is higher than the positive rail voltage and a negative output voltage to the distribution switch that is more negative than the negative rail voltage. In practice, the positive output voltage will be approximately double the positive rail voltage and the negative output voltage will be approximately double the negative rail voltage. Accordingly, this configuration provides both a positive pulse output and a negative pulse output with a minimum number of transistors, and correspondingly less-complicated biasing requirements.

Figure 8:
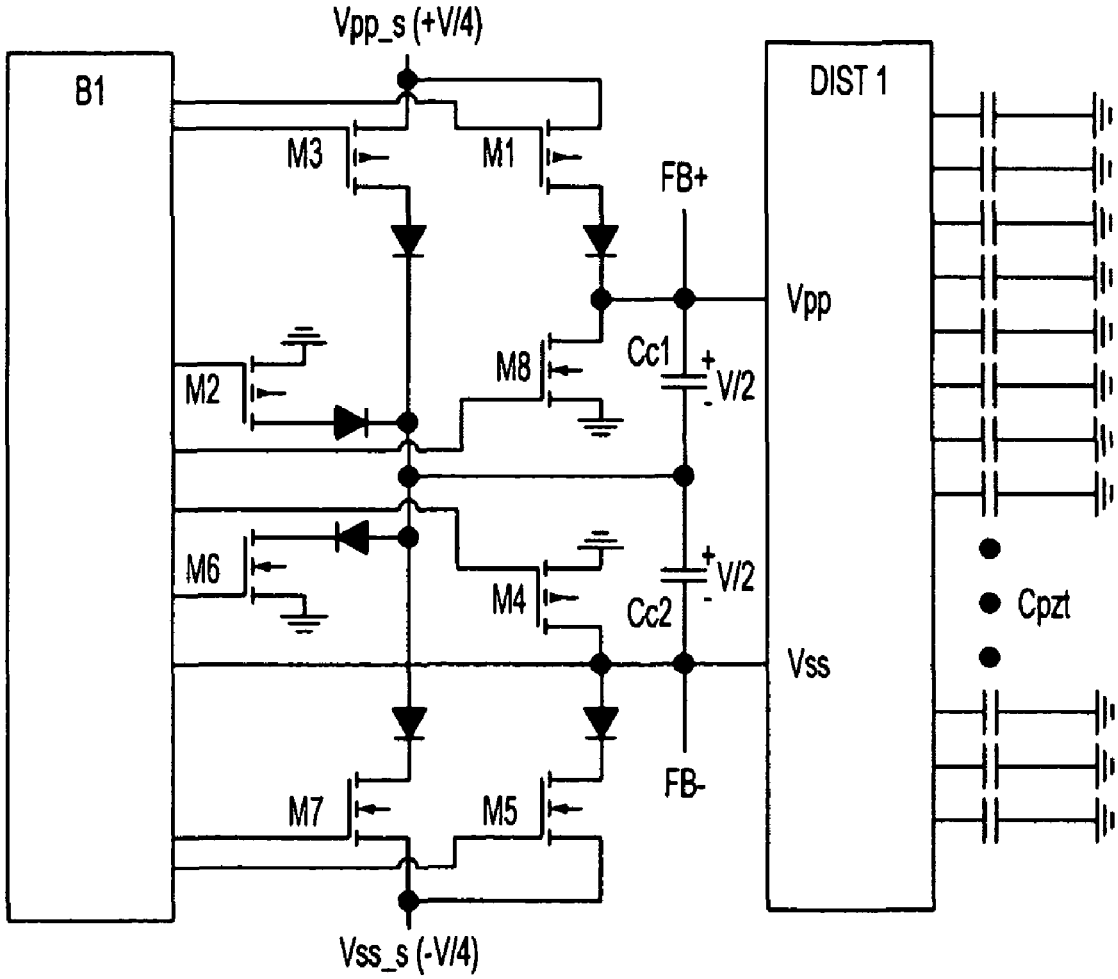
FIG. 8 illustrates another embodiment of the common drive dual polarity amplifier of FIG. 7.

FIG. 8 illustrates another embodiment of the common drive dual polarity amplifier of FIG. 7. The embodiment of FIG. 8 may achieve power efficiency enhancement as compared to the common drive dual polarity amplifier of FIG. 7. Referring to FIG. 8, the common drive pulse amplifier provides both a positive pulse output $V_{pp}$ and a negative pulse output $V_{ss}$ but only uses rail voltages of ±V/4. Consequently, in this configuration, the common drive pulse amplifier reduces the power dissipated by a factor of 4 and the individual MOSFET power dissipated by a factor of 8. Thus, this configuration also benefits from the advantages described above with respect to FIG. 4A.

The common drive pulse amplifier according to this embodiment includes eight transistors M1-M8 and two capacitors $C_{c1}$ and $C_{c2}$. A lower voltage terminal of the capacitor $C_{c1}$ is connected to a higher voltage terminal of the capacitor $C_{c2}$ such that each of the capacitors $C_{c1}$ and $C_{c2}$ charges up to a voltage of approximately double the positive rail voltage. Thus, an output voltage of approximately double the positive rail voltage $V_{pp_s}$ is provided to the positive terminal $V_{pp}$ of the distribution switch. Similarly, an output voltage of approximately double the negative rail voltage $V_{ss_s}$ is provided to the negative terminal $V_{ss}$ of the distribution switch.

Also shown in FIG. 8 is a biasing circuit B1. The biasing circuit B1 provides sequencing and timing signals for the MOSFETs M1-M8. The biasing circuit B1 can be a Field-Programmable Gate Array (FPGA), an Application-Specific Integrated Circuit (ASIC), or the like. The complexity of the biasing circuit B1 for each amplifier configuration can be related to the number of transistors in the amplifier, and thus amplifier configurations with fewer transistors can use simpler biasing devices. Although only shown in FIG. 8, a person of ordinary skill in the art will appreciate that a biasing circuit B1 can be used with each of the described embodiments.

Although described above in the context of linear feedback power amplifiers for pulsed waveform applications, the inventive principles can be applied to AC waveform applications as well. Also, in the amplifiers described above, a capacitor element is utilized to pump up the output voltage because capacitors do not require current flow to store energy. However, similar results can be obtained using inductor implementations. Additionally, in the embodiments described above, the MOSFET devices are connected in a common connected drain output drive configuration. However, the MOSFET devices could be connected with common connected source output drive to achieve alternative drive characteristics. A gate drive configuration is also possible but could be more complex, using higher voltage supplies or charge-pumped gate drive enhancement.

The amplifiers described above can provide certain advantages when used to drive solid ink PZT print heads. For example, the drive signals for the PZT print heads can be generated from a power amplifier with reduced power supplies (owing to the lower rail voltages), thus improving the amplifier power delivery efficiency with less power dissipated in the amplifiers. After the initial charging of the capacitor, the energy stored in the capacitor is delivered to and from the PZT transducers efficiently with minimal delivery losses. The charge-pump architectures described above provide the required drive waveforms for the print heads using reduced amplifier power supplies, ideally half the previously used power supply voltages, resulting in half the power dissipation. The maximum power dissipated in any individual MOSFET is further reduced by the power sharing from the additional MOSFETs. The additional MOSFETs in these architectures provide one approach for efficiency improvements over parallel MOSFETs or duplicating entire current drivers. Also, the biased MOSFET architectures described above increase circuit stability.

In practice, the coupling energy storage capacitors described above, with their equivalent series resistances (ESR) can be sized relative to the voltage division ratio with the maximum capacitive load from the PZT transducers to determine the actual power supply voltage reduction. Additionally, the amplifier MOSFETs can be sequenced to optimize balanced power dissipation sharing.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electronic device to drive a plurality of transducers in a print head, comprising:

at least one first transistor operatively connected to a reduced positive rail voltage, the reduced positive rail voltage having a level less than a positive rail voltage and a terminal, the at least one first transistor configured to drive the terminal to the positive rail voltage;

at least one second transistor operatively connected to a reference voltage and the terminal, the at least one second transistor configured to drive the terminal to the reference voltage;

at least one capacitor operatively connected to the terminal, the capacitor configured to provide a boosted output voltage to the transducers in the print head equal to the positive rail voltage causing the print head to dispense a fluid, wherein the first transistor comprises a first pair of MOSFETs operatively connected to opposite terminals of the capacitor respectively and configured to drive the opposite terminals of the capacitor to the positive rail voltage, and the second transistor comprises a second pair of MOSFETs operatively connected to the opposite terminals of the capacitor respectively and configured to drive the opposite terminals of the capacitor to the reference voltage;

a first diode disposed between the capacitor and a selected one of the first pair of MOSFETs;

a second diode disposed between the capacitor and a selected one of the second pair of MOSFETs; and a distribution switch operatively connected to the terminal and configured to select a subset of the transducers to receive the boosted output voltage.

2. The electronic device of claim 1, further comprising:

at least one third transistor operatively connected to a negative rail voltage;

at least one fourth transistor operatively connected to the reference voltage;

at least one additional capacitor operatively connected to the third and fourth transistors, the additional capacitor configured to provide a boosted negative output voltage to the transducers more negative than the negative rail voltage.

3. The electronic device of claim 2, wherein a lower voltage terminal of the capacitor is operatively connected to a higher voltage terminal of the additional capacitor such that each of the capacitor and the additional capacitor produces a voltage of approximately double the positive rail voltage.

4. The electronic device of claim 1, further comprising:

at least one third transistor operatively connected to a negative rail voltage; and at least one fourth transistor operatively connected to the reference voltage, wherein the capacitor is further configured to provide a boosted negative output voltage to the transducers more negative than the negative rail voltage.

5. The electronic device of claim 1, further comprising:

at least one third transistor operatively connected to a negative rail voltage;

at least one fourth transistor operatively connected to the reference voltage;

a resistor operatively connected between a high voltage terminal of the capacitor and the reference voltage; and a diode operatively connected between the high voltage terminal of the capacitor and the reference voltage, wherein the first, second, third, and fourth transistors are operatively connected to a low voltage terminal of the capacitor.

6. The electronic device of claim 1, further comprising a distribution switch configured to provide the boosted output voltage to at least one selected transducer from the plurality of transducers.

7. The electronic device of claim 1, further comprising a biasing circuit configured to provide sequencing and timing signals to the first and second transistors.

8. A system, comprising:

at least one nozzle;

at least one diaphragm;

at least one transducer configured to operate the diaphragm to dispense fluid through the nozzle;

an amplifier configured to provide a boosted output voltage to the transducer, the amplifier comprising:

at least one first transistor operatively connected to a reduced positive rail voltage, the reduced positive rail voltage having a level less than a positive rail voltage;

at least one second transistor operatively connected to a reference voltage;

at least one capacitor operatively connected to the first and second transistors, the capacitor configured to provide the boosted output voltage to the transducer equal to the positive rail voltage, wherein the first transistor comprises a first pair of MOSFETs operatively connected to opposite terminals of the capacitor respectively, and the second transistor comprises a second pair of MOSFETs operatively connected to opposite terminals of the capacitor respectively;

a first diode operatively connected to a selected one of the first pair of MOSFETs; and a second diode operatively connected to a selected one of the second pair of MOSFETs; and a distribution switch operatively connected to the transducer and the amplifier, the switch configured to select the transducer to receive the boosted output voltage.

9. The system of claim 8, the amplifier further comprising:

at least one third transistor operatively connected to a negative rail voltage;

at least one fourth transistor operatively connected to the reference voltage;

at least one additional capacitor operatively connected to the third and fourth transistors, the additional capacitor configured to provide a boosted negative output voltage to the transducer more negative than the negative rail voltage.

10. The system of claim 9, wherein a lower voltage terminal of the capacitor is operatively connected to a higher voltage terminal of the additional capacitor such that each of the capacitor and the additional capacitor produces a voltage of approximately double the positive rail voltage.

11. The system of claim 8, the amplifier further comprising:

at least one third transistor operatively connected to a negative rail voltage; and at least one fourth transistor operatively connected to the reference voltage, wherein the capacitor is further configured to provide a boosted negative output voltage to the transducer more negative than the negative rail voltage.

12. The system of claim 8, wherein the at least one transducer comprises a plurality of transducers and wherein the system further comprises a distribution switch configured to provide the boosted output voltage to at least one selected transducer from the plurality of transducers.

13. The system of claim 8, further comprising a biasing circuit configured to provide sequencing and timing signals to the first and second transistors.

14. A method for driving a plurality of transducers in a print head, comprising:

supplying a reduced positive rail voltage less than a positive rail voltage to at least one first transistor;

supplying a reference voltage to at least one second transistor;

sequentially activating the first and second transistors such that an output voltage equal to the positive rail voltage is supplied to a distribution switch connected to the first transistor, second transistor, and the transducers;

supplying the positive rail voltage to a subset of the transducers in the print head by selecting the subset with the distribution switch such that the print head dispenses a fluid;

supplying the positive rail voltage comprises supplying the positive rail voltage to a first MOSFET and a second MOSFET operatively connected to opposite terminals of a capacitor respectively;

supplying the reference voltage comprises supplying the reference voltage to a third MOSFET and a fourth MOSFET operatively connected to opposite terminals of the capacitor respectively; and sequentially activating the first and second transistors comprises sequentially activating the first MOSFET to raise the output voltage to the positive rail voltage, activating the second MOSFET to pump the output voltage above the positive rail voltage, activating the third MOSFET to reduce the output voltage to the positive rail voltage, and activating the fourth MOSFET to reduce the output voltage to the reference voltage.

15. The method of claim 14, further comprising:

supplying a negative rail voltage to at least one third transistor;

supplying the reference voltage to at least one fourth transistor;

sequentially activating the third and fourth transistors such that an output voltage more negative than the negative rail voltage is supplied to the transducers.

* * * * *